US005111559A

United States Patent [19]

Mohr et al.

[11] Patent Number: 5,111,559

[45] Date of Patent: May 12, 1992

[54] COFFINS

[75] Inventors: Jacob G. Mohr; Michael H. Kane; Etienne Le Riche, all of Cape Town, South Africa

[73] Assignee: Timbalyte Close Corporation, Cape Town, South Africa

[21] Appl. No.: 637,052

[22] Filed: Jan. 3, 1991

[30] Foreign Application Priority Data

Jan. 4, 1990 [ZA] South Africa ..... 90/0045
Feb. 28, 1990 [ZA] South Africa ..... 90/1547

[51] Int. Cl.[5] ..... A63G 17/00
[52] U.S. Cl. ..... 27/4; 27/7
[58] Field of Search ..... 27/2, 4, 7, 6, 19, 27, 27/35

[56] References Cited

U.S. PATENT DOCUMENTS 4,123,831 11/1978 Covington .
4,399,596 8/1983 Parlour et al. ..... 27/4
4,891,869 1/1990 Nutting .
5,035,032 7/1991 Nutting ..... 27/4

FOREIGN PATENT DOCUMENTS 1183329 3/1970 United Kingdom ..... 27/4
1535188 6/1975 United Kingdom .
2003835 3/1979 United Kingdom ..... 27/4

*Primary Examiner*—Richard E. Chilcot, Jr.
*Attorney, Agent, or Firm*—Kenyon & Kenyon

[57] ABSTRACT

A coffin is disclosed which comprises a three part base which lies below a full length base insert. The three parts of the base lie end-to-end below the insert and include vertical panels which constitute the foot and head end walls of the coffin. The sides of the coffin comprise vertical outer wall panels and vertical inner inserts. The outer wall panels are integral with flaps which lie below the coffin base. The lid is in two parts which are joined by a transverse strip.

10 Claims, 6 Drawing Sheets

COFFINS

FIELD OF THE INVENTION

THIS INVENTION relates to coffins.

BACKGROUND TO THE INVENTION

Many proposals have been made in the past regarding the use of relatively inexpensive corrugated board, instead of scarce and expensive wood, as a material for coffins. Corrugated board, however, over a long span has insufficient bending strength. Consequently it is necessary to resort to the use of a number of components which are overlapped with one another thereby to provide for an increase in strength. This complicates the assembly procedure but is an unavoidable expedient. A further problem which must be overcome is that of appearance. The coffin must not look as if it is of corrugated board. This means that the corrugated board must be printed to simulate wood or laminated to a sheet which is printed to simulate wood. Furthermore, as far as is possible, exposed cut edges of the board must be avoided as these clearly reveal the material that has been used. An example of a coffin comprising a number of corrugated cardboard components is found in British specification 1535188.

According to the present invention there is provided a coffin which is of corrugated board and which comprises a lid and a base, the base having a base wall comprising a base insert which extends the full length of the coffin, which is wider at a shoulder zone thereof and which tapers towards the ends thereof and a base wall panel which is adhered to the underside of the base insert, the base further including side walls each of which comprises a side panel having first and second panel parts with a vertically extending bend between them at said shoulder zone, and bottom flaps integral with said panel parts and joined thereto along right angled bends, said bottom flaps adhered to the underside of the base wall panel.

Because it is difficult accurately to cut corrugated board which has a long span, said base wall panel is preferably in three parts which are arranged end-to-end, each of the end parts including a first panel which is adhered to the underside of the base insert and a second panel which forms a coffin end wall, there being right angled bends between said first and second panels of each end part.

To provide for a stiff rim at each end of the base said panels forming said coffin end walls have strips joined thereto along pairs of parallel crease lines, said strips being folded over and adhered to the inner faces of said end walls.

Said bottom flaps cover substantially the entire area of said base wall panel thereby further enhancing the strength of the coffin.

The longitudinal, central joint line between the bottom flaps can be concealed by a longitudinally extending strip which is adhered to the bottom flaps.

To provide the maximum strength it is preferred that the corrugations of the base wall panel extend longitudinally and the corrugations of said bottom flaps and of the base insert extend transversely.

To strengthen the side walls, side wall inserts are adhered to the inner faces of said panel parts, there being strips along the upper edges of said panel parts which strips are folded over and adhered to the inner faces of said side wall inserts thereby to provide strong rims.

Said strips are preferably joined to said panel parts along pairs of parallel crease lines whereby, when the strips are folded, horizontal caps are formed which surmount said inserts To provide the greatest strength the corrugations of said side wall inserts extend horizontally.

The lid desirably comprises two lid parts each of which includes a panel and margins folded over to lie beneath the panel, there being a lid insert beneath each panel, said margins being adhered to said lid inserts, and there being a transverse strip below said lid parts, the strip being adhered to said lid parts to join said lid parts to one another.

For a better understanding of the present invention, and to show how the same may be carried into effect, reference will now be made, by way of example, to the accompanying in which:

FIG. 1 is an isometric view of a coffin comprising a base and a lid;

FIGS. 2*a*, 2*b* and 2*c* are top plan views of three blanks which form part of the coffin base wall and also form the head and foot walls;

FIGS. 3*a* and 3*b* are plan views of blanks each of which forms a side wall and part of the base wall;

Figure 6A:
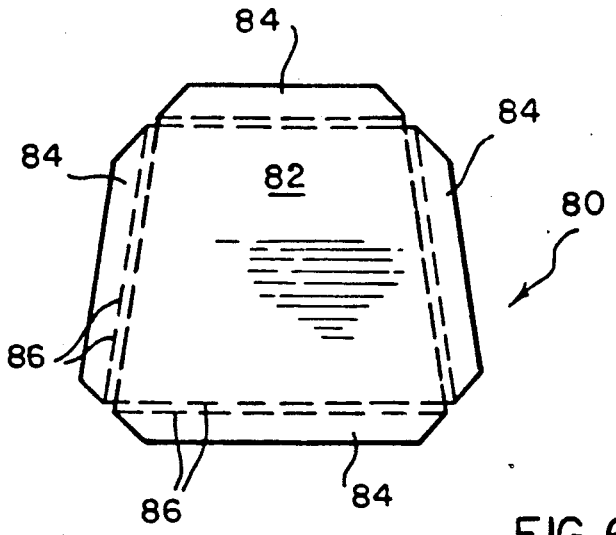
Figure 6B:
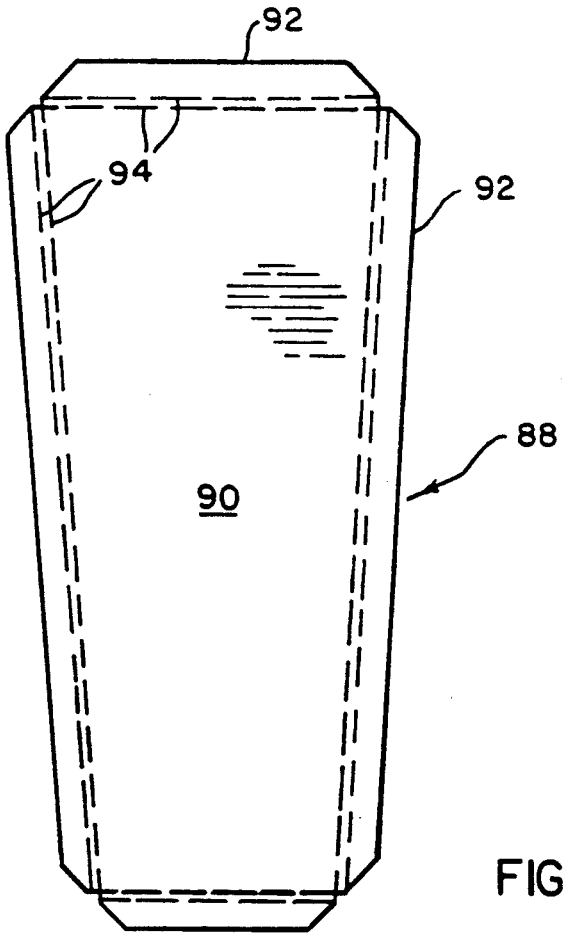
Figure 7A:
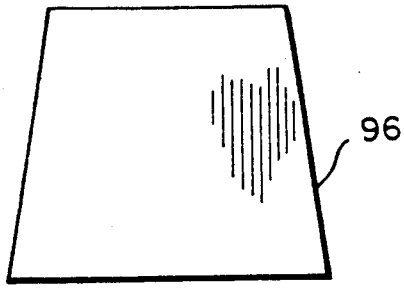
Figure 7B:
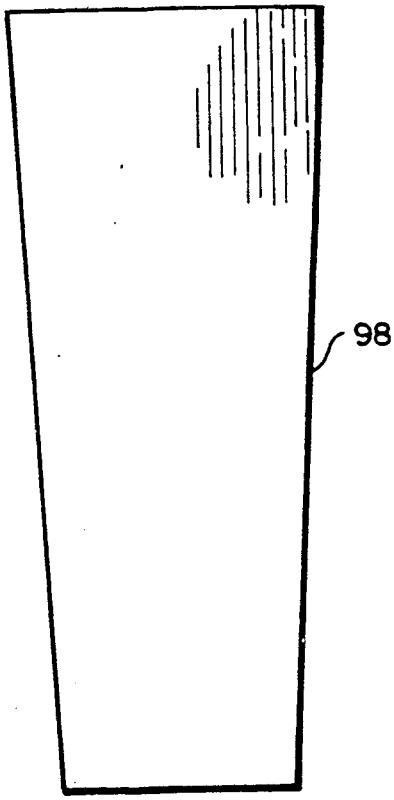
Figure 8:
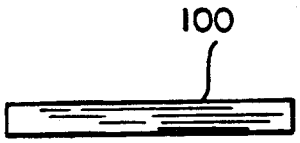
Figures 9, 10:
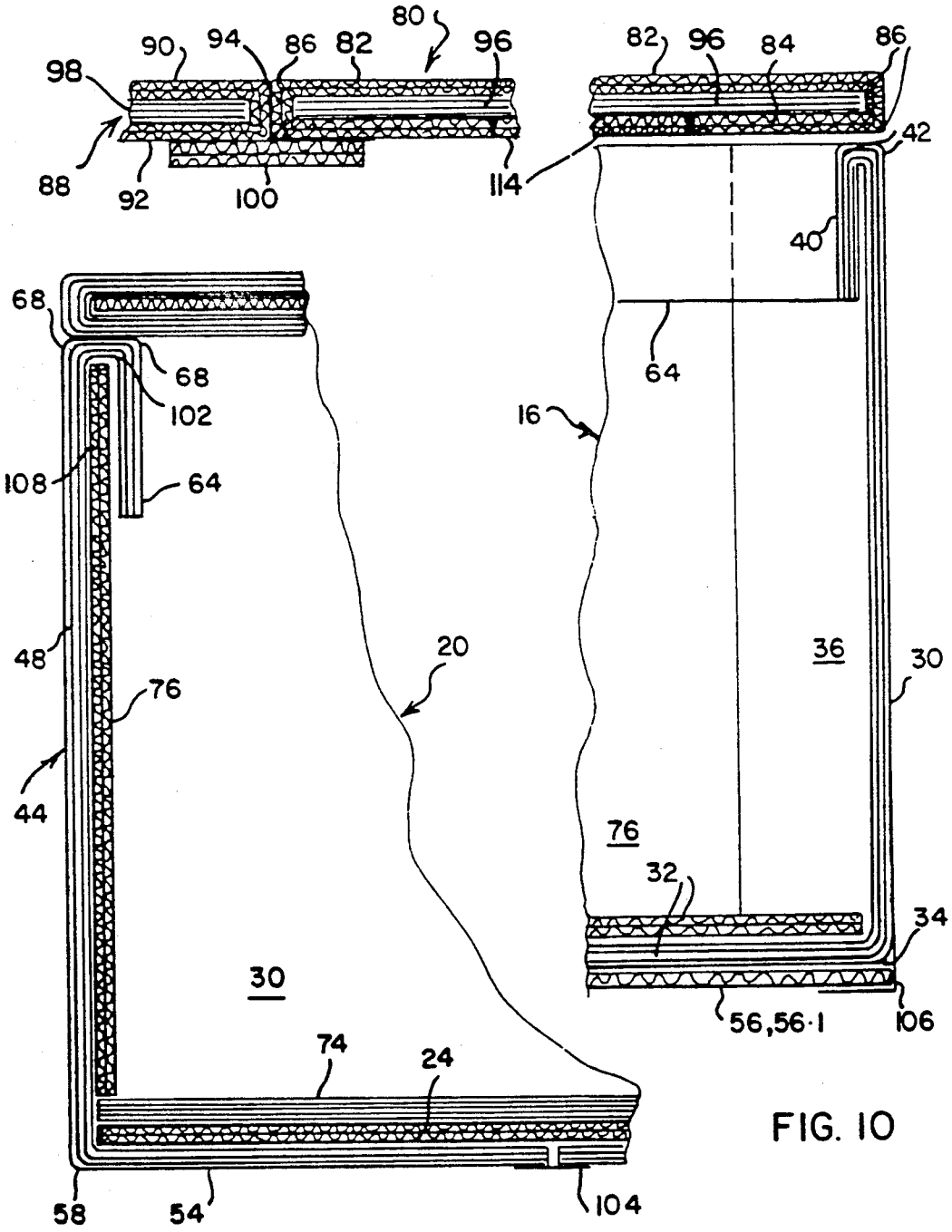

FIGS. 6*a* and 6*b* illustrates blanks which together form a coffin lid;

FIGS. 7*a* and 7*b* illustrate coffin lid inserts;

FIG. 8 illustrates a lid seal;

FIG. 9 is a vertical section, to a larger scale, through the left hand side wall of the coffin with the lid fitted to the base; and FIG. 10 is a vertical partial section through the head wall and lid.

Figure 1:
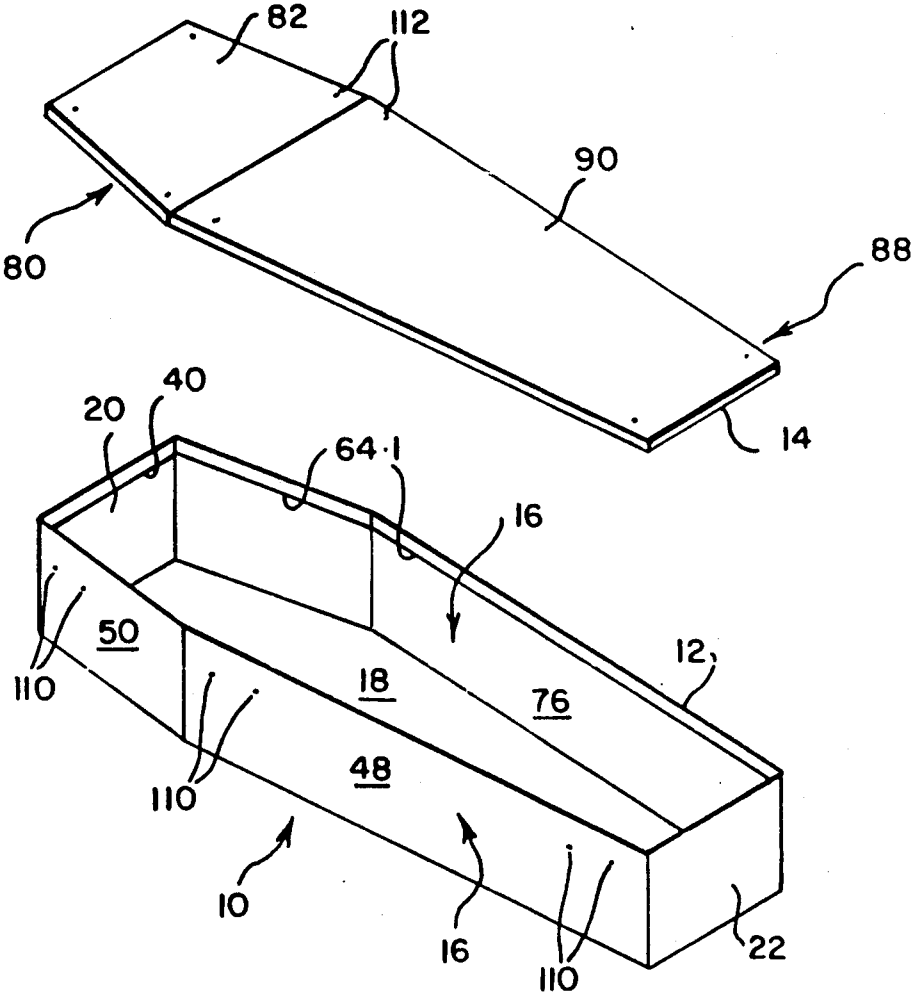

Referring firstly to FIG. 1, the coffin illustrated is generally designated 10 and comprises a base 12 and a lid 14. The base 12 comprises side walls 16, a base wall 18, a head end wall 20 and a foot end wall 22.

Figure 2A:
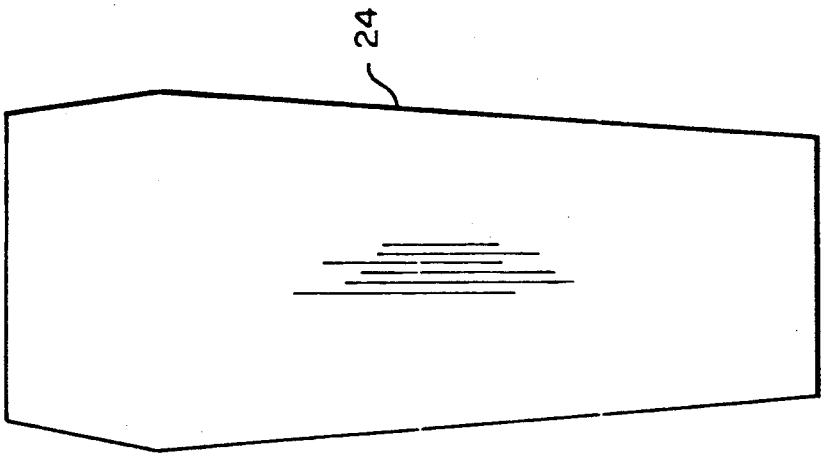
Figure 2C:
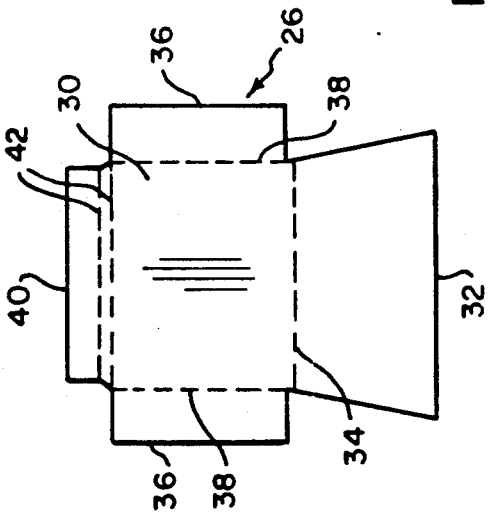
Figure 2B:
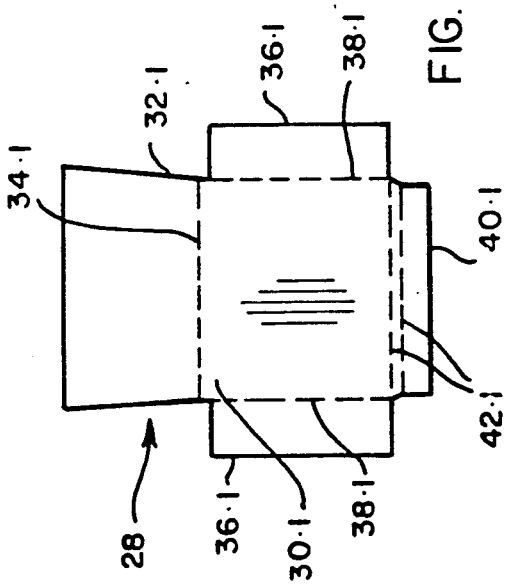

The base wall 18 is of composite construction and includes three blanks 24, 26 and 28 (see FIGS. 2*a*, 2*b* and 2*c*) of corrugated board. The blanks 24, 26 and 28 together form a base wall panel. The blank 24 extends over the major part of the length of the base wall 18. The blank 26 includes a head end wall panel 30 and a panel 32 which in use forms an extension of the blank 24. The panels 30 and 32 are joined along a transverse crease line 34. Connecting tabs 36 are joined along crease lines 38 to two of the remaining edges of the panel 30 and a strip 40 is connected along a double crease line 42 to the remaining edge of the panel 30.

The blank 28 is similar to the blank 26 and like parts have been designated by like reference numerals with the addition of the suffix 1.

Figure 3A:
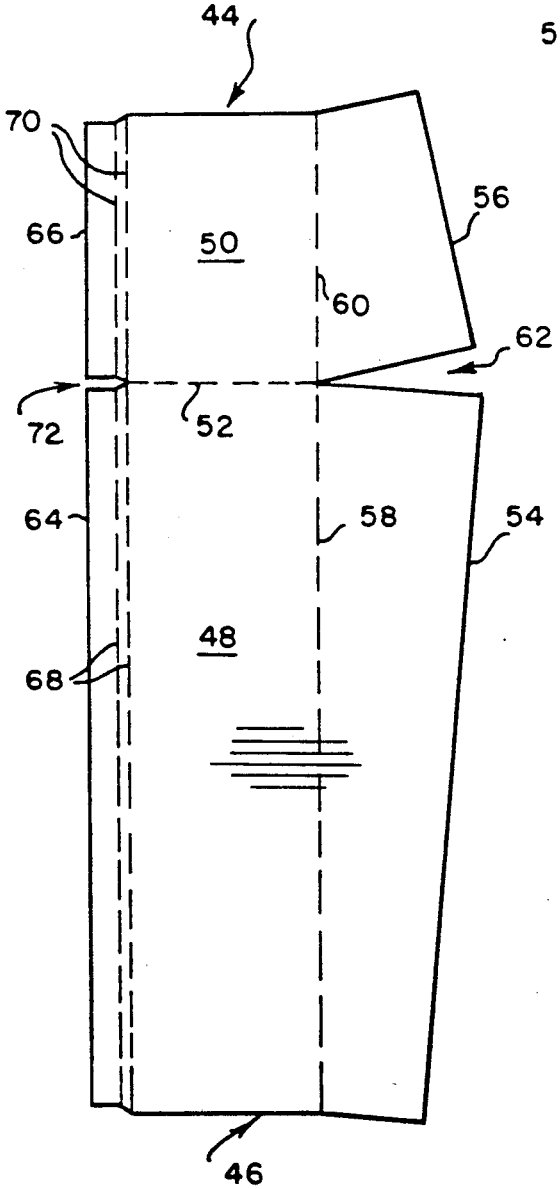

The blank 44 illustrated in FIG. 3*a* constitutes part of one composite side wall 16 (see FIG. 1) of the coffin. The blank 44 comprises a panel 46 which is divided into two parts 48 and 50 by a vertically extending crease line 52. Bottom flaps 54 and 56 are connected to the panel parts 48 and 50 along crease lines 58 and 60 which form the bottom edges of the parts 48 and 50. It will be noted that there is a V-shaped gap designated 62 between the bottom flaps 54 and 56, the apex of the V-shaped gap 62 being where it intersects the aligned crease lines 58, 60.

Along the upper edges of the parts 48, 50 there are strips 64, 66 respectively. The strips 64 and 66 are joined to the panel parts 48 and 50 along double crease lines 68 and 70. There is a gap 72 between the strips 64 and 66, the gap 72 having an apex in the region where the crease lines 68 and 70 intersect the crease line 52.

Figure 3B:
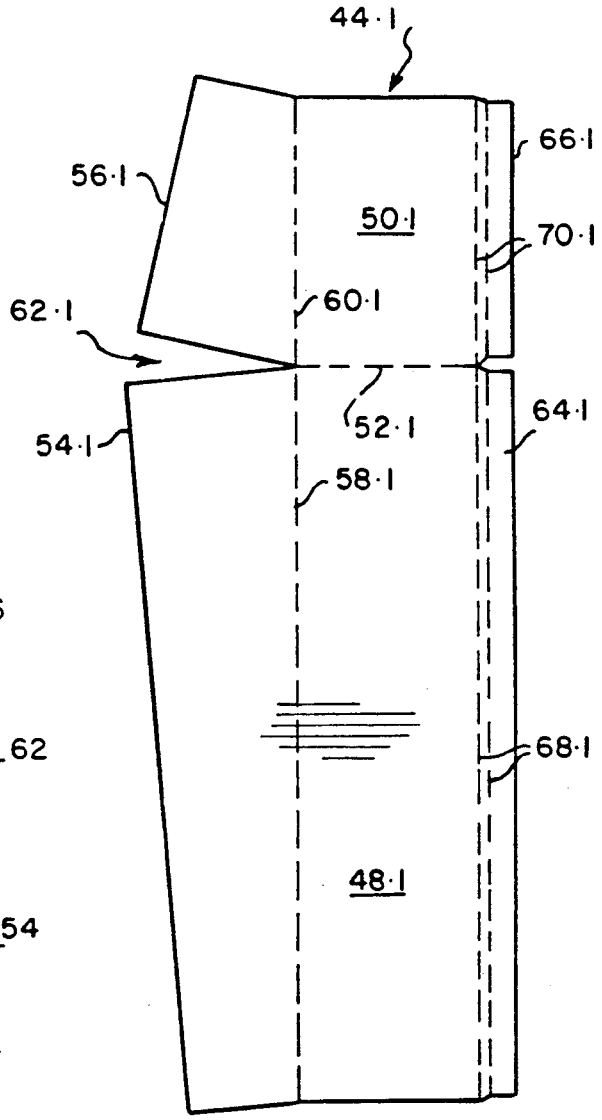

The blank 44 of FIG. 3*a* forms part of the left hand wall 16 of the coffin, as viewed from the foot end. The blank 44.1 of FIG. 3*b* forms part of the right hand wall of the coffin. In FIG. 3*b* like parts have been designated by the same reference numerals as are used in FIG. 3*a* with the addition of the suffix .1.

Figure 4:
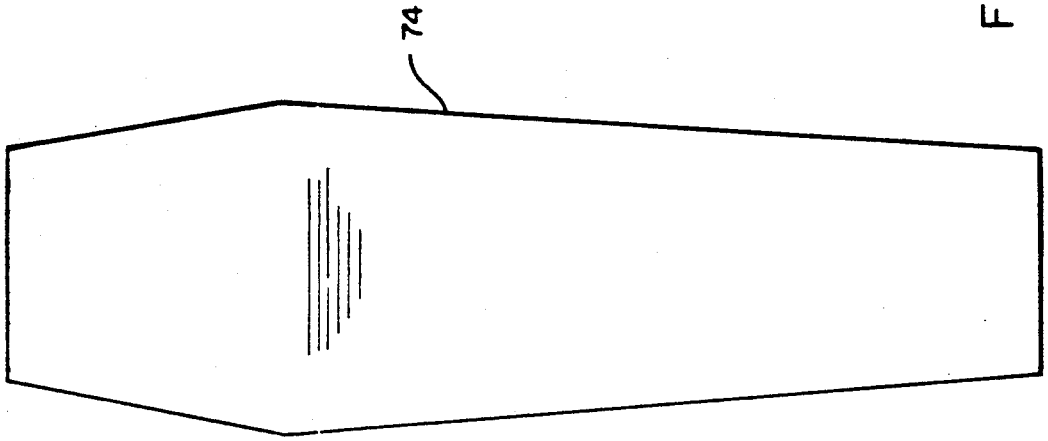
FIG. 4 is a plan view of a base insert.
Figure 5:
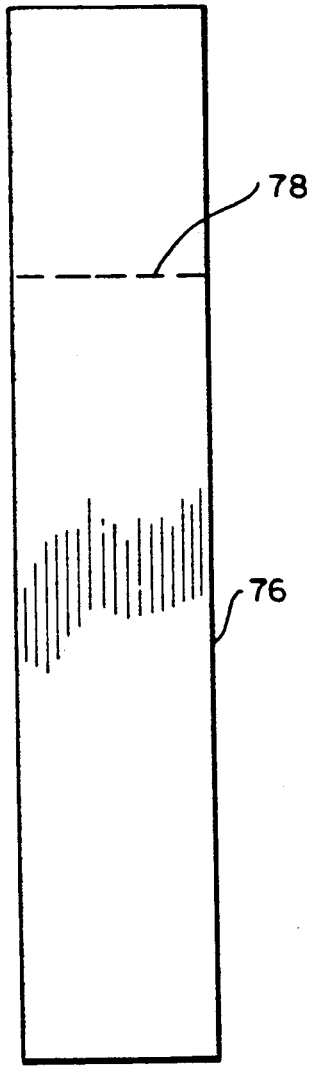
FIG. 5 illustrates a side wall insert.

FIGS. 4 and 5 illustrate strengthening inserts. The insert of FIG. 4 is required in larger size coffins and two of the inserts of FIG. 5 in all coffins. The insert illustrated in FIG. 4 is designated 74 and is a base wall insert. Its shape is identical to that of the combined blank 24 and panels 32 and 32.1. The insert 76 of FIG. 5 is the same shape as the panel parts 48, 50 and 48.1, 50.1 of FIGS. 3*a* and 3*b*, the insert 76 having a crease line 78 therein which matches the crease lines 52 and 52.1.

The coffin lid is in two parts, these being illustrated in FIGS. 6*a* and 6*b*. The first part is designated 80 and comprises a lid panel 82 with a strip-like margin 84 extending completely around it. The margin 84 is joined to the panel 82 along a double crease line 86. The second part 88 is shown in FIG. 6*b* and comprises a lid panel 90 and an encircling margin designated 92 which is joined to the panel 90 along a double crease line 94. As best illustrated in FIGS. 9 and 10, the margins 84 and 92 are folded under the panels 82 and 90 so as to strengthen the edges of the lid.

FIGS. 7*a* and 7*b* illustrate lid inserts designated 96 and 98 which match in shape the panels 82 and 90 of FIGS. 6*a* and 6*b*. FIG. 8 illustrates a strip 100 which, as will be described in more detail hereinafter, is used to join the parts 80 and 88.

In all the FIGS., except FIGS. 1, 9 and 10, the groups of parallel lines indicate the direction in which the corrugations run.

To assemble the coffin, two inserts 76 are placed against the inner faces of the two blanks 44 and 44.1. The inserts 76 and the panel parts 48, 50, 48.1 and 50.1 of the blanks 44 and 44.1 are adhered to one another over their entire areas. The strips 64, 66, 64.1 and 66.1 are then folded over and adhered to the inner upper edge zones of the inserts 76. The double folds 68, 70, 68.1 and 70.1 result in caps 102 (FIG. 9) which surmount the upper edges of the inserts 76. This provides the two side walls.

The blanks 24, 26 and 28 are then adhered to the underface of the base insert 74 with the free transverse edges of the panels 32 and 32.1 abutting the transverse edges of the blank 24. The panels 30 and 30.1 protrude beyond the insert 74, the crease lines 34 and 34.1 coinciding with the transverse edges of the insert 74. Thus the entire blank 24 and the panels 32 and 32.1 of the blanks 26 and 28 are adhered to the insert 74.

The blanks 44 and 44.1 are then folded about the crease lines 58, 60, 58.1 and 60.1 so that the flaps 54, 56, 54.1 and 56.1 lie beneath the composite structure constituted by the blanks 24, 26 and 28 and the insert 74 and are adhered thereto over their entire areas. As best seen in FIG. 9, the edges of the flaps 54, 54.1 and 56, 56.1 are close to one another once they have been folded under the base panel 24. The flaps are connected to one another by a glued paper strip 104.

The blanks 26 and 28 are then folded about the crease lines 34 and 34.1 to stand up the panels 30 and 30.1. Simultaneously the blanks 26 and 28 are folded about the crease lines 38 and 38.1 so that the tabs 36 and 36.1 lie inwardly of the vertical end zones of the panel parts 48, 50, 48.1 and 50.1 (see FIG. 10). These tabs are adhered to the panels 48, 50, 48.1 and 50.1. The coffin base is completed by folding over the strips 40 and 40.1 and adhering them to the inner faces of the panels 30 and 30.1 (see also FIG. 10).

The lid 14 is assembled by folding the margins 84 and 92 under the panels 82 and 90 respectively with the inserts 96 and 98 between the panels 82 and 90 and the margins 84 and 92. The strip 100 (see FIGS. 8 and 10) is then used to secure the two parts together by adhering it to the margins 84 and 92.

A paper strip 106 (see FIG. 10) is used to cover the gap between the flaps 56, 56.1 and the panel 30. A similar construction is used at the foot end to cover the gap between the foot end panel 30.1 and the flaps 54, 54.1.

If desired, plugs such as those known as "Rawl" plug can be inserted into bores which are in the region designated 108 in FIG. 9. The plugs are positioned with their axes vertical and serve to receive screws which pass downwardly through the coffin lid. The plugs prevent the screws which are used to hold the lid on from being detached accidentally, it being understood that corrugated board does not necessarily receive and hold a screw tightly.

As will be seen from FIGS. 2*a*, 2*b*, 2*c*, 5, 7*a* and 7*b*, the corrugations of all these components extend longitudinally. The corrugations of the side panels 48, 50, 48.1 and 50.1 (FIGS. 3*a* and 3*b*) extend vertically whereas the corrugations of the flaps 54, 56, 54.1 and 56.1 extend transversely. Likewise the corrugations of the insert 74 (FIG. 4) and of the lid parts 80 and 88 (FIGS. 6*a* and 6*b*) extend transversely as do the corrugations of the strip 100.

The pairs of dots 110 in FIG. 1 indicate the positions of the handles. The dots 112 indicate the position of the screws which secure the lid 14 to the base 12.

In order that the lid has a smooth underface without any visible corrugations, filler panels are provided beneath the inserts 96 and 98. The filler panel beneath the insert 96 is designated 114 and completely fills the space which is bounded by the folded-under margins 84. Thus the cut edges of the margins 84 and of the filler panel 114 are concealed and, apart from the strip 100, the underside of the lid is flat. A further filler panel (not shown) is provided below the insert 98, the edges of this further filler panel abutting the margins 92.

We claim:

1. A coffin which is of corrugated board and which comprises a lid and a base, the base having a base wall comprising a base insert which extends the full length of the coffin, which is wider at a shoulder zone thereof and which tapers towards the ends thereof and a base wall panel which is adhered to the underside of the base insert, the base further including side walls each of which comprises a side panel having first and second panel parts with a vertically extending bend between them at said shoulder zone, and bottom flaps integral with said panel parts and joined thereto along right angled bends, said bottom flaps being adhered to the underside of the base wall panel.

2. A coffin according to claim 1 in which said base wall panel is in three parts which are arranged end-to-end, each of the end parts including a first panel which is adhered to the underside of the base insert and a second panel which forms a coffin end wall, there being right angled bends between said first and second panels of each end part.

3. A coffin according to claim 2 in which said panels forming said coffin end walls have strips joined thereto along pairs of parallel crease lines, said strips being folded over and adhered to the inner faces of said end walls.

4. A coffin according to claim 1 in which said bottom flaps cover substantially the entire area of said base wall panel.

5. A coffin according to claim 4 in which the longitudinal, central joint line between the bottom flaps is concealed by a longitudinally extending strip which is adhered to the bottom flaps.

6. A coffin according to claim 1 in which the corrugations of the base wall panel extend longitudinally and the corrugations of said bottom flaps and of the base insert extend transversely.

7. A coffin according to claim 1 and including side wall inserts adhered to the inner faces of said panel parts, there being strips along the upper edges of said panel parts which strips are folded over and adhered to the inner faces of said side wall inserts.

8. A coffin according to claim 7 in which said strips are joined to said panel parts along pairs of parallel crease lines whereby, when the strips are folded, horizontal caps are formed which surmount said inserts.

9. A coffin according to claim 7 in which the corrugations of said side wall inserts extend horizontally.

10. A coffin according to claim 1 in which said lid comprises two lid parts each of which includes a panel and margins folded over to lie beneath the panel, there being a lid insert beneath each panel, said margins being adhered to said lid inserts, and there being a transverse strip below said lid parts, the strip being adhered to said lid parts to join said lid parts to one another.

* * * * *